United States Patent [19]

Darner

[11] Patent Number: 4,747,182

[45] Date of Patent: May 31, 1988

[54] DRAPERY TRAVERSE ROD AND SUPPORT BRACKET

[75] Inventor: Ronald G. Darner, Fort Atkinson, Wis.

[73] Assignee: Graber Industries, Inc., Madison, Wis.

[21] Appl. No.: 943,377

[22] Filed: Dec. 16, 1986

[51] Int. Cl.[4] ..... A47H 15/00

[52] U.S. Cl. ..... 16/87.4 R; 16/94 D; 16/95 D; 160/345; 248/265

[58] Field of Search ..... 16/87.4 R, 87.4 W, 87.6 R, 16/87.6 W, 93 R, 93 D, 94 R, 94 D, 95 R, 95 D, 95 W, 95 DW, 96 R, 96 D, 96 L; 160/345; 240/265, 271, 272

[56] References Cited

U.S. PATENT DOCUMENTS 3,247,893 4/1966 Ford ..... 16/94 D X 3,470,578 10/1969 Graber et al. .

*Primary Examiner*—Fred Silverberg

*Attorney, Agent, or Firm*—Vernon J. Pillote

[57] ABSTRACT

A drapery traverse rod of the type having telescopically adjustable inner and outer rods each having a lengthwise extending trackway and a lengthwise extending dovetail shaped mounting rail at the rear side. A rod engaging bracket has a first pair of outer rod engaging jaws at one end adapted to engage a dovetail shaped mounting rail on the outer rod and a second pair of inner rod engaging jaws at the other end adapted to engage a dovetail shaped mounting rail on the inner rod. A mounting bracket is adapted for attachment at one end to a supporting surface and the rod engaging bracket can be selectively and reversibly mounted in the rod engaging bracket with either the outer rod engaging jaws or the inner rod engaging jaws positioned forwardly of the mounting bracket for engagement with the mounting rail on the respective outer or inner rod.

12 Claims, 3 Drawing Sheets

Fig. 7.
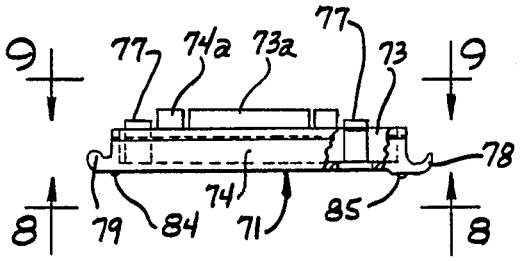
Fig. 14.
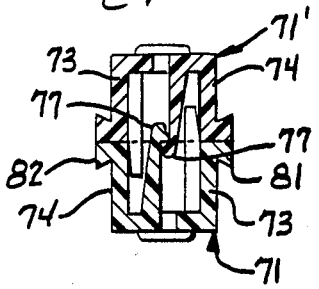
Fig. 8.
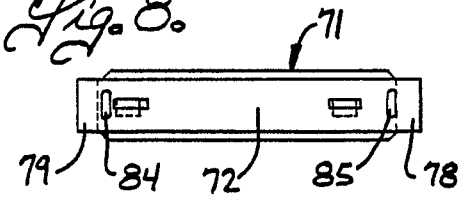
Fig. 9.
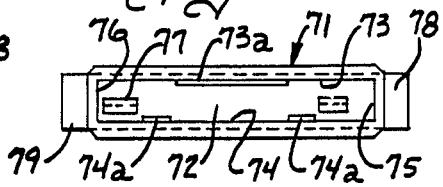
Fig. 10.
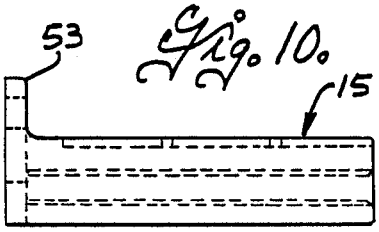
Fig. 11.
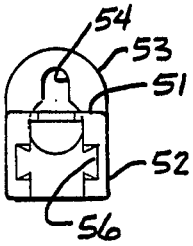
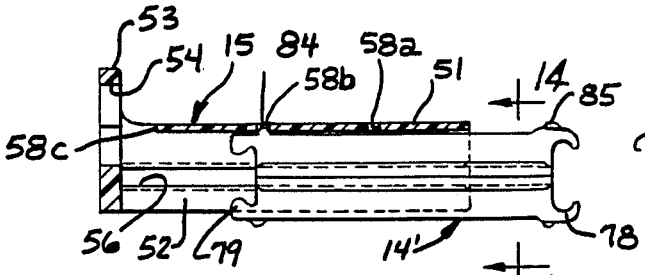
Fig. 12.
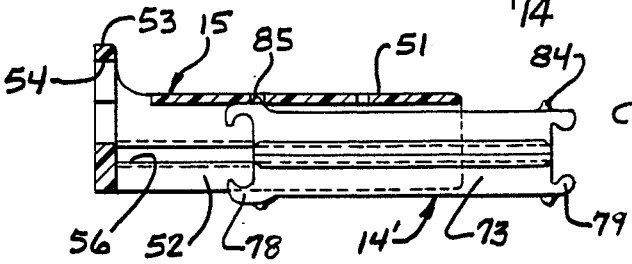
Fig. 13.

DRAPERY TRAVERSE ROD AND SUPPORT BRACKET

BACKGROUND OF THE INVENTION

Some drapery traverse rods have heretofore been made as disclosed in U.S. Pat. No. 3,470,578 with telescopically adjustable inner and outer hollow rods each having a dovetailed shaped mounting rail along their rear side and a support bracket for engaging the mounting rail to support the rod. The support bracket disclosed in that patent included a rod engaging bracket having a single pair of rail engaging jaws with one jaw adjustable toward and away from the other by means of a threaded fastener to accommodate the different size mounting rails on the inner and outer rods. The rod engaging bracket in that patent was slidably mounted on a wall mounting bracket to adjust the spacing of the rod from the supporting surface and the rod engaging bracket was adapted to be locked in an adjusted position on the mounting bracket by another threaded fastener. This support bracket arrangement not only required manufacture and assembly of a number of parts including the screw fasteners, but also required the use of a screw driver in order to adjust the rod engaging bracket to the rails on the inner and outer rods, and to adjust the rod engaging bracket relative to the mounting bracket.

SUMMARY OF THE INVENTION

The present invention provides a drapery rod and support in which a rod engaging bracket can be adapted to engage a mounting rail on the rear side of either an inner or outer telescopically adjustable rod without requiring the use of tools.

The present invention also provides a support bracket in which a rod engaging bracket can be adjusted relative to a mounting bracket without the use of tools.

In general, the invention comprises telescopically adjustable inner and outer rods each having a dovetailed shaped mounting rail along the rear side, and an elongated rod engaging bracket having a first pair of outer rod engaging jaws at one end adapted to engage the dovetailed mounting rail on the outer rod and a second pair of inner rod engaging jaws at the other end adapted to engage the dovetailed mounting rail on the inner rod. A wall mounting bracket is adapted for attachment to a supporting surface and the rod engaging bracket is arranged so that it can be selectively and reversibly mounted on the mounting bracket with either the outer rod engaging jaws or the inner rod engaging jaws disposed forwardly of the forward end of the mounting bracket.

In accordance with another aspect of the present invention, the rod engaging bracket has lengthwise extending flanges along opposite sides and the mounting bracket has channels for slidably receiving the flanges on the rod engaging bracket to enable adjustment of the rod engaging bracket relative to the mounting bracket, and interengaging detent means are provided on the rod engaging bracket and mounting bracket for releasably retaining the rod engaging bracket in different adjusted positions on the mounting bracket.

BRIEF DESCRIPTION OF THE DRAWINGS

FIG. 7 is a side view of one part of a modified form of rod engaging bracket;

FIG. 8 is a view taken on the plane 8—8 of FIG. 7;

FIG. 9 is a view taken on the plane 9—9 of FIG. 7;

FIG. 10 is a side elevational view of a mounting bracket;

FIG. 11 is an end view of the mounting bracket of FIG. 10;

FIG. 12 is a longitudinal sectional view through the mounting bracket and rod engaging bracket shown assembled for supporting the outer rod of a telescoping rod assembly;

FIG. 13 is a longitudinal sectional view through the mounting bracket and rod engaging bracket shown assembled for supporting the inner rod of a telescoping rod assembly; and FIG. 14 is a transverse sectional view through the rod engaging bracket taken on the plane 14—14 of FIG. 12 and showing the parts on a larger scale than in FIG. 12.

DETAILED DESCRIPTION

Figure 1:
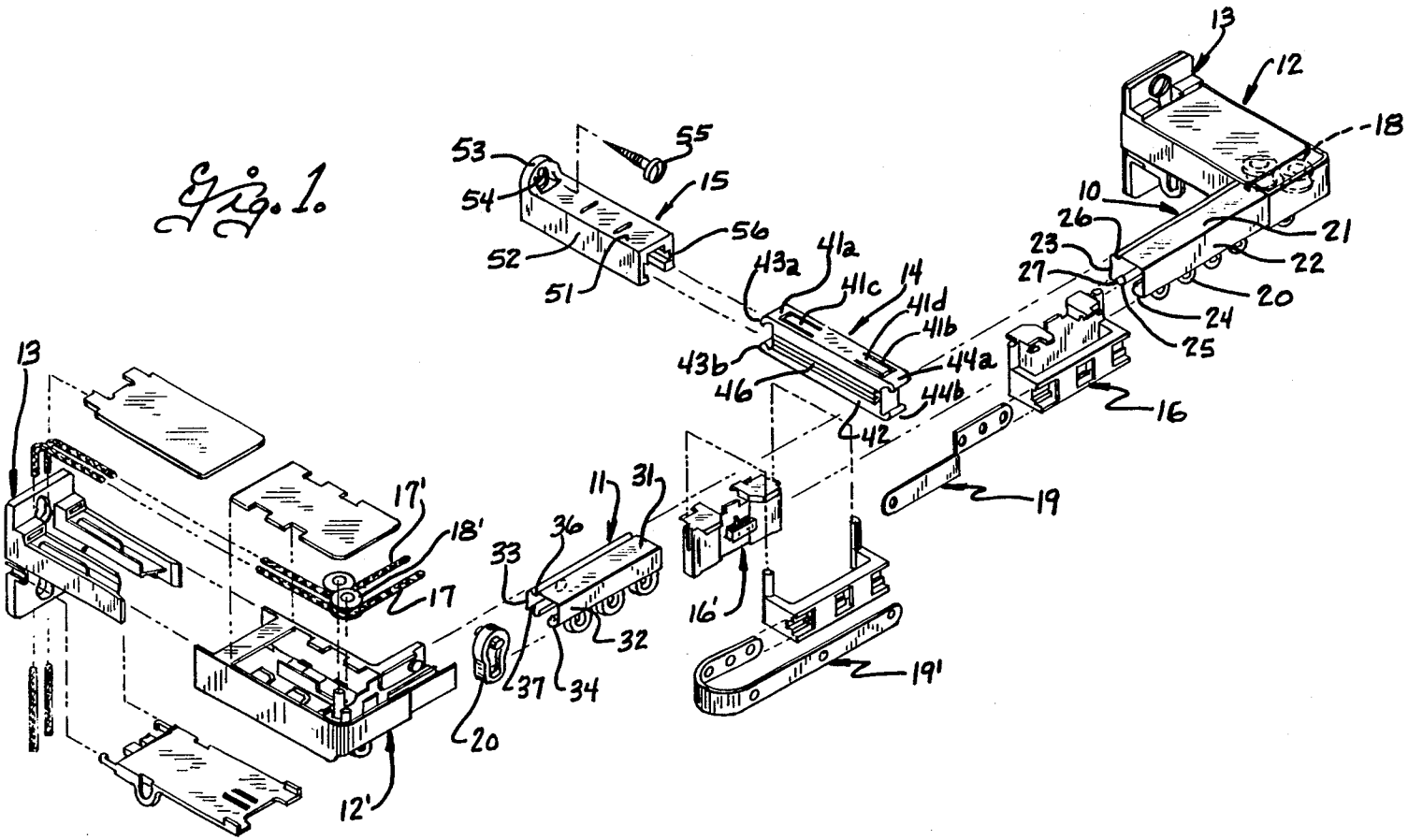
FIG. 1 is an exploded perspective view of an adjustable traverse rod and support bracket embodying the present invention.

Reference is now made more specifically to FIG. 1 of the drawings wherein there is illustrated an adjustable traverse rod assembly embodying the present invention. In general, the adjustable traverse rod assembly is of the type having a downwardly opening slot at the bottom thereof and includes an outer rod 10 and an inner rod 11 telescopically receivable in the outer rod. Pulley housings 12 and 12' are provided at opposite ends of the traverse rod assembly and the pulley housings are supported on mounting brackets 13 adapted for attachment to a supporting surface such as a wall, window frame or the like. One or more intermediate rod engaging brackets 14 are provided for engaging the rod assembly intermediate its ends and the intermediate rod engaging bracket is mounted on an intermediate mounting bracket 15 adapted for attachment to a supporting surface. One or more master carriers, herein shown two in number and designated 16, 16' are mounted for movement along the rod assembly and the master carriers are operated by traverse cords having runs 17, 17' extending lengthwise of the rod assembly and entrained over pulleys 1S, 18' in the pulley housings 12 and 12' respectively. The traverse cords are operatively connected to the master carriers to effect movement of the master carriers along the rod assembly and the master carriers have drapery support arms 19, 19' for supporting the lead edge of the drapery panels. A plurality of auxiliary drapery carriers 20 are also slidably supported in the rod assembly to support the drapery panels at locations intermediate the master carriers and the pulley housings at the ends of the rod assembly.

Figure 5:
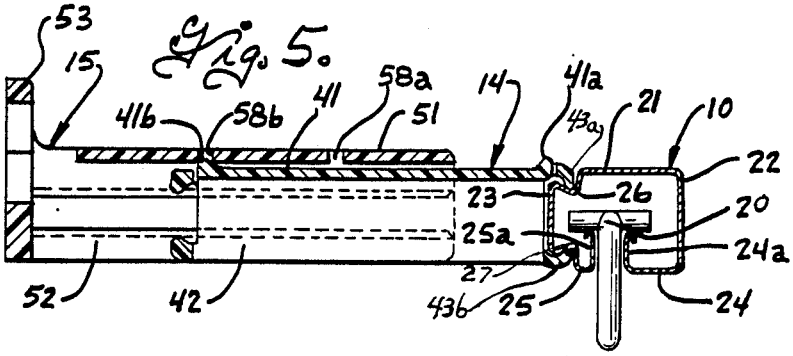
FIG. 5 is a longitudinal sectional view through the mounting bracket and rod engaging bracket assembled for supporting the outer rod of a telescoping rod assembly.

The outer and inner telescopically adjustable rods 10 and 11 are formed of metal strip and are of the type having a downwardly opening slot in the bottom and a generally dovetail shaped mounting rail at the rear side. As best shown in FIG. 5, the outer rod 10 includes top wall 21, a front wall 22, a rear wall 23 and forward and rear bottom wall portions 24 and 25 that are spaced apart to define a downwardly opening slot in the bottom of the wall. The forward bottom wall extends rearwardly from the lower edge of the front wall 22 and has a forward guide rail 24*a* extending upwardly along one side of the slot and which terminates in a upper guide edge. The rear bottom wall 25 has a rear rail 25*a* extending upwardly from the forward edge of the rear wall and which terminates in an upper guide edge. The top wall 21 is formed with a reentrant angle 26 which defines an upwardly opening channel adjacent the rear wall and the rear bottom wall 25 is formed with a reentrant angle 27 which defines the downwardly opening channel adjacent the rear wall. As shown in FIG. 5, the reentrant angles 26 and 27 in conjunction with the rear wall 23 form a generally dovetail shaped mounting rail at the rear side of the outer rod.

Figure 4:
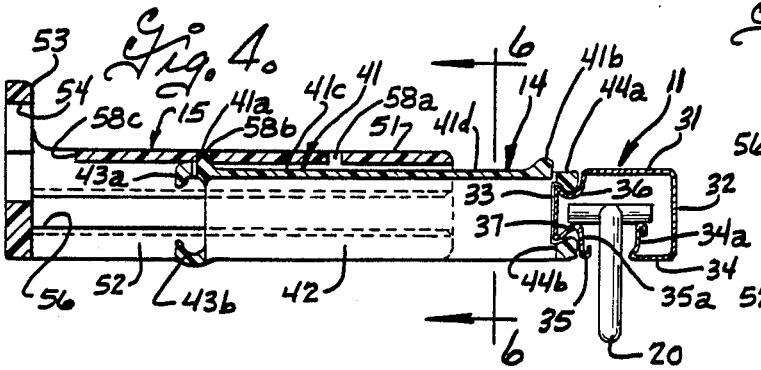
FIG. 4 is a longitudinal sectional view through the wall mounting bracket and rod engaging bracket assembled for supporting the inner rod of a telescoping rod assembly.

The inner rod 11 is formed complementary to the outer rod and with an outer cross section sufficiently smaller to be telescopically receivable therein. As shown in FIG. 4, the inner rod includes a top wall 31, front wall 32, rear wall 33, and forward and rear bottom walls 34 and 35. The forward and rear bottom walls are spaced apart to define a slot therebetween and have rails 34*a*, 35*a* along opposite sides of the slot. The top wall has a reentrant angle 36 formed therein defining an upwardly opening channel adjacent the rear wall 33 and the rear bottom wall 35 has a reentrant angle 37 formed therein and defining a downwardly opening channel adjacent the rear wall 33. The reentrant angles 36 and 37 in conjunction with the rear wall 33 form a mounting rail of dovetail shaped cross section at the rear of the inner rod. As will be seen from a comparison of FIGS. 4 and 5, the dovetail shaped mounting rail at the rear of the inner rod is smaller than the dovetail shaped mounting rail on the outer rod so as to be slidably receivable therein.

In the embodiment of FIGS. 2–6, the rod engaging bracket 14 is formed in one piece and is slidably and adjustably mounted in the mounting bracket 15. The rod engaging bracket 14 has a top wall 41 and depending side walls 42. A first pair of opposed outer rail engaging jaws 43*a*, 43*b* are formed integrally with one end of the rod engaging bracket and are shaped and spaced to receive the dovetail shaped mounting rail on the outer rod 10 as shown in FIG. 5. The rod engaging bracket also has a second pair of opposed inner rod engaging jaws 44*a* and 44*b* at its other end and which are shaped and spaced apart to receive the dovetail shaped mounting rail on the inner rod 11, as shown in FIG. 4.

Figure 6:
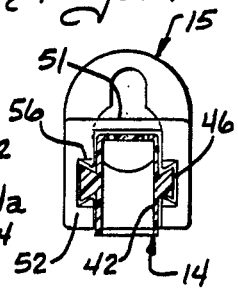
FIG. 6 is a transverse sectional view taken on the plane 6—6 of FIG. 4.

The rod engaging bracket is reversibly and adjustably mounted in the mounting bracket so that either the outer or the inner pair of jaws can be positioned at the front of the mounting bracket engage the mounting rail on the respective outer and inner rods 10 and 11. The rod engaging bracket has lengthwise extending flanges 46 along opposite sides, which flanges preferably have a generally dovetail shaped configuration as best shown in FIG. 6. The mounting bracket 15 has a generally U-shaped cross section and includes a top wall 51 and depending side walls 52. A means in the form of a mounting flange 53 is provided on one end of the mounting bracket with a fastener receiving opening 54 of preferably keyhole shape. The mounting bracket is adapted for mounting on a support surface such as a wall or window frame and may be mounted as by a screw fastener 55 (FIG. 1) that extends through the keyhole shaped opening 54. The side walls 52 of the mounting bracket have generally horizontal channels 56 which are adapted to slidably receive the flanges 46 on the rod engaging bracket and the channels 56 preferably have a dovetail shaped cross section generally complementary to the dovetail cross section of the channels and such that the flanges interlock in the channels and inhibit spreading of the sides 52 of the mounting bracket.

Figure 2A:
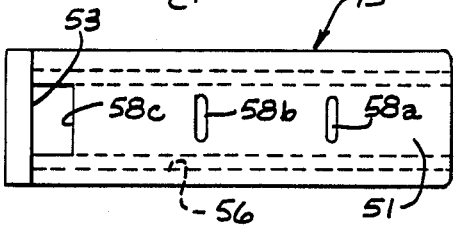
FIGS. 2*a* and 2*b* are top plan views of a wall mounting bracket and rod engaging bracket respectively.
Figure 2B:
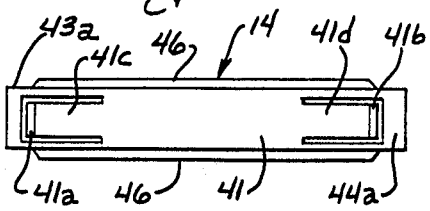
Figure 3A:
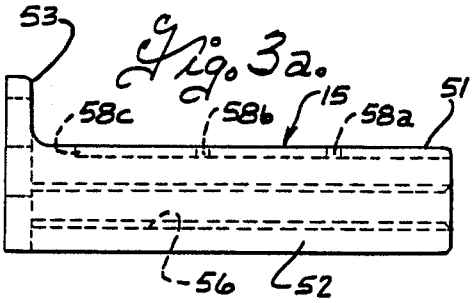
FIGS. 3*a* and 3*b* are side elevational views of a wall mounting bracket and rod engaging bracket respectively.
Figure 3B:
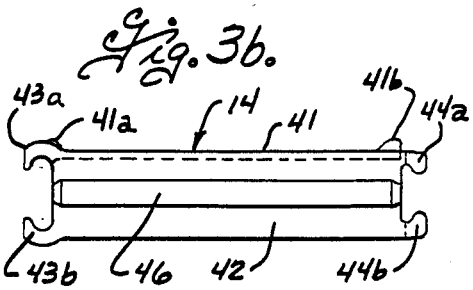

A detent means is provided for releasably retaining the rod engaging bracket 14 in different adjusted positions relative to the mounting bracket 15. For this purpose, the top wall 51 of the mounting bracket is formed with a plurality of detent receiving recesses at spaced locations therealong. In the embodiment shown, the recesses are in the form of openings 58*a*–58*c* that extend through the top wall at spaced locations therealong. A first protrusion or detent 41*a* is formed on the rod engaging member adjacent one end and adapted for engagement with the recesses 51*a*–51*c* to releasably retain the rod engaging bracket in different adjusted positions on the mounting bracket when the inner rod engaging jaws 44*a*, 44*b* are located forwardly of the mounting bracket as shown in FIG. 4, and second protrusion or detent 41*b* is provided on the rod engaging bracket adjacent its other end for engagement with the recesses 58*a*–58*c*, when the outer rod engaging jaws 43*a*, 43*b* are disposed forwardly of the mounting bracket for engagement with the outer rod as shown in FIG. 5. The detents 41*a* and 41*b* are preferably formed at the distal ends of first and second finger portions 41*c* and 41*d* respectively that are integrally joined at one end to the rod engaging bracket so that the distal ends of the fingers and the detents thereon are resiliently movable vertically of the rod engaging bracket. The fingers 41*c* and 41*d* are conveniently formed by molding a U-shaped opening through each end of the top wall 41 of the rod engaging bracket, as best shown in FIG. 2*b*. With this arrangement, the detents 41*a* and 41*b* can be depressed relative to the top wall 41 as the detents move from one detent receiving recess to another.

As previously described, the jaws 43*a*, 43*b* are shaped and arranged to engage the dovetail shaped mounting rail at the rear of the outer rod and the jaws 44*a*, 44*b* are shaped and arranged to engage the dovetail shaped mounting rail at the rear of the inner rod. The jaws can be assembled on the rails of the respective inner and outer rods from the ends of the rods and the rod engaging bracket then moved along the rail to the desired location along the rod. However, the inner and outer rods 10 and 11 are formed from metal strip and are somewhat resilient and it is contemplated that the jaws 43*a*, 43*b* and 44*a*, 44*b* be constructed and arranged so that they can be snapped onto the respective mounting rail intermediate its ends.

In the embodiment of FIGS. 7–14, the mounting bracket 15 is the same as that described in connection with the embodiment of FIGS. 2–6 and the same numerals are used to designate the same parts. In the embodiment of FIGS. 7–14, a modified rod engaging bracket 14' is formed from two like members 71, and like numerals are used to designate the corresponding parts. Each of the members 71 has a generally U-shaped cross section and includes a base wall 72 and spaced side walls 73 and 74 and end walls 75 and 76. The members 71 are adapted to be assembled in opposed relation as shown in FIGS. 12–14. In order to maintain the members in lateral and longitudinal registry, the members are formed with a locating flange 73*a* on one side wall and a pair of locating flanges 74*a* on the opposite side wall. The flanges 73*a* and 74*a* are arranged to extend inside the inner side wall on the opposed part as shown in FIG. 14. As best shown in FIGS. 7 and 9, the flange 73*a* on wall 73 has a length slightly less than the spacing between the flanges 74*a* on wall 74 so that, when one part is assembled in inverted relation on the other part, the flange 73*a* on one part is disposed between the flanges 74*a* on the other part. Latches 77 are formed integrally with the base wall of each of the members 71 at spaced locations therealong and extend to a level adjacent the open side of the respective member so that the latches engage and interlock when the members 71 are pressed together in opposed relation as shown in FIG. 14.

Each member 71 is formed with an outer rail engaging jaw 78 at one end and an inner rail engaging jaw 79 at its opposite end. When two members 71 are assembled in opposed relation as shown in FIGS. 12–14, the outer rail engaging jaws 78 at one end of the rod engaging bracket 14' are arranged to engage and grip the dovetail shaped rail at the rear of the outer rod 10, and the opposed jaws 79 at the other end of the rod engaging bracket are shaped and arranged to engage the rail at the rear of the inner rod 11. As will be apparent, the two members 71 can be snapped together in opposed relation at any location along the rod and with the appropriate jaws positioned to grip the rail on the respective inner and outer rods. Alternatively, the two members 71 can be snapped together and the inner or outer jaws then assembled on the rail of the respective inner or outer rod by sliding onto the rod from one end of the rod, or by snapping the jaws over the rail intermediate its ends as described in connection with the embodiment of FIGS. 2–7.

Each member 71 is formed with flanges 81 and 82 that extend along the sides 73, 74. When two members 71 are assembled in opposed relation, the flanges 81, 82 on one member mate with flanges 82, 81, respectively on the other member to form a guide flange on the rod engaging member 14'. The guide flange preferably has a generally dovetail shaped cross section as best shown in FIG. 14 to mate with the dovetail shaped grooves 56 in the mounting bracket 15. Protrusions or detents 84 and 85 are provided on each of the parts 71 adjacent opposite ends. One of the detents 84 is arranged to engage in selected ones of the detent receiving recesses 58*a*–58*c* in the mounting bracket when the outer rod engaging jaws 78 on the rod engaging bracket are disposed forwardly of the mounting brackets shown in FIG. 12, and the other detent 85 is arranged to engage in selected ones of detent receiving recesses 58*a*–58*c* in the mounting bracket, when the inner rail engaging jaws are positioned forwardly of the mounting bracket as shown in FIG. 13. Thus, the members 71 can be snapped together either with the jaws 78 engaging the rail on the outer rod or with the jaws 79 engaging the rail on the inner rod, and the rod engaging member can then be slidably and adjustably assembled onto the mounting bracket 15. With this arrangement, the rod engaging bracket can be assembled onto either the inner or outer rod and the rod engaging bracket thereafter assembled onto the mounting bracket without the use of any tools. As is deemed apparent, the detents 84 and S5 can be formed on the distal ends of vertically resilient cantilevered arms similar to those described at 41*c* and 41*d* in the embodiment of FIGS. 1–5.

The embodiments of the invention in which an exclusive property or privilege is claimed are defined as follows:

1. A drapery traverse rod and support therefor comprising, telescopically adjustable inner and outer hollow rods each having a trackway extending lengthwise thereof and means defining a generally dovetail shaped mounting rail along a rear side of the inner and outer rods, wherein the inner rod rail has a different shape from the outer rod rail, an elongated rod engaging bracket having a pair of outer rod engaging jaws at one end adapted to engage the mounting rail on the outer rod and a pair of inner rod engaging jaws at the other end adapted to engage the mounting rail on the inner rod, wherein the inner rod engaging jaws have a different shape from the outer rod enaging jaws a mounting bracket having forward and rear ends and means at the rear end thereof adapted for attachment to a mounting surface, and means for selectively and reversibly mounting the rod engaging bracket on the mounting bracket with either said pair of outer rod engaging jaws or said pair of inner rod engaging jaws of said rod engaging bracket disposed forwardly of the forward end of the mounting bracket.

2. A drapery traverse rod and support therefor according to claim 1 wherein said rod engaging bracket is mounted for lengthwise adjustment relative to the mounting bracket.

3. A drapery traverse rod and support therefor according to claim 1 wherein said rod engaging bracket has lengthwise extending flange means along opposite sides thereof, said mounting bracket having opposed channel means for slidably receiving the flange means on the rod engaging bracket, and interengaging means on the rod engaging bracket and the mounting bracket for releasably retaining the elongated rod engaging bracket in different lengthwise adjusted positions relative to the mounting bracket.

4. A drapery traverse rod and support therefor according to claim 1 wherein mounting bracket has means defining guide passage means for slidably receiving said elongated rod engaging bracket and wall means having at least two detent receiving recesses spaced apart in a direction lengthwise of guide passage means, first detent means adjacent one end of said rod engaging member adapted to engage said detent receiving recesses in the mounting bracket when said other end of the rod engaging bracket is disposed forwardly of the mounting bracket, and second detent means adjacent said other end of said rod engaging member adapted to engage said detent receiving recesses in the mounting bracket when said one end of the rod engaging bracket is disposed forwardly of the mounting bracket.

5. A drapery traverse rod and support therefor according to claim 4 wherein said rod engaging bracket has first and second finger portions each integrally joined at one end to the rod engaging bracket and each having a distal end resiliently movable vertically of the rod engaging bracket, said first and second detent means being respectively formed integrally with the first and second finger portions adjacent their distal ends.

6. A drapery transverse rod and support therefor according to claim 1 wherein said elongated rod engaging bracket has lengthwise extending flange means along opposite sides thereof, said mounting bracket having a top wall and depending side walls, said side walls having opposed generally horizontal channels in the inner side faces thereof for slidably receiving the flange means on the rod engaging bracket, the top wall of the mounting bracket having at least two detent receiving recesses therein at locations spaced apart along said mounting bracket, a first detent means adjacent said one end of the rod engaging member adapted to engage the detent receiving recesses in the top wall of the mounting bracket when said other end of the rod engaging bracket is disposed forwardly of mounting bracket, a second detent means adjacent said other end of the rod engaging bracket adapted to engage said detent receiving recesses in the top wall of the mounting bracket when said one end of the rod engaging bracket is disposed forwardly of the mounting bracket.

7. A drapery traverse rod and support therefor according to claim 6 wherein said rod engaging bracket has first and second finger portions each integrally joined at one end to the rod engaging bracket and each having a distal end resiliently movable vertically of the rod engaging bracket, said first and second detent means being respectively formed integrally with the first and second finger portions adjacent their distal ends.

8. A drapery traverse rod and support therefor comprising, telescopically adjustable inner and outer hollow rods each having a trackway extending lengthwise thereof and means defining a generally dovetail shaped mounting rail along a rear side of the inner and outer rods, wherein the inner rod rail has a different shape from the outer rod rail, a rod engaging bracket including first and second elongated bracket members, means for interconnecting the first and second bracket members in side-by-side relation, the first and second bracket members respectively having first and second outer rod engaging jaws at one end adapted to engage the mounting rail on the outer rod when the first and second bracket members are interconnected in side-by-side relation, the first and second bracket members respectively having first and second inner rod engaging jaws at the other end thereof adapted to engage the mounting rail on the inner rod when the first and second bracket members are interconnected in side-by-side relation, wherein the inner rod engaging jaws have a different shape from the outer rod engaging jaws a mounting bracket having forward and rear ends and means at the rear end thereof adapted for attachment to a support surface, and means for selectively mounting the rod engaging bracket on the mounting bracket with either said one end or said other end of the rod engaging bracket disposed forwardly of said forward end of the mounting bracket.

9. A drapery traverse rod and support therefor according to claim 8 wherein said means for interconnecting said first and second elongated bracket members includes latch means formed integrally with said first and second members and adapted to interengage when the first and second elongated bracket members are pressed into side-by-side engagement.

10. A drapery traverse rod and support therefor according to claim S wherein said first and second elongated bracket engaging members each having outer flange means extending along opposite sides thereof, said mounting bracket having channel means adapted to slidably receive said outer flange means on the first and second elongated bracket members.

11. A drapery traverse rod and support therefor according to claim 10 including interengaging means on the rod engaging bracket and the mounting bracket for releasably retaining the rod engaging bracket in different positions on the mounting bracket.

12. A drapery traverse rod and support therefor according to claim 8 wherein said first and second elongated bracket engaging members have the same configuration.

* * * * *